US006360961B1

(12) United States Patent
Marazzi

(10) Patent No.: US 6,360,961 B1
(45) Date of Patent: Mar. 26, 2002

(54) DISPENSING MACHINE FOR THE METERED DELIVERY AND CONTINUOUS HOMOGENIZATION OF FINISHED PAINT PRODUCTS

(75) Inventor: Umberto Marazzi, Medolla (IT)

(73) Assignee: Corob S.p.A., San Felice sul Panaro MO (IT)

( * ) Notice: Subject to any disclaimer, the term of this patent is extended or adjusted under 35 U.S.C. 154(b) by 0 days.

(21) Appl. No.: 09/582,798

(22) PCT Filed: Nov. 6, 1998

(86) PCT No.: PCT/EP98/07091

§ 371 Date: Aug. 28, 2000

§ 102(e) Date: Aug. 28, 2000

(87) PCT Pub. No.: WO99/34905

PCT Pub. Date: Jul. 15, 1999

(30) Foreign Application Priority Data

Dec. 30, 1997 (IT) ..... B097A0742

(51) Int. Cl.[7] ..... B05B 1/28; B05B 15/02; A62C 13/62

(52) U.S. Cl. ..... 239/104; 239/106; 239/303

(58) Field of Search ..... 239/303, 304, 239/335, 124, 127, 112, 106, 104, 305, 398, 418, 419, 422, 428, 433, DIG. 14; 118/300, 302, 602, 629

(56) References Cited

U.S. PATENT DOCUMENTS

| | | | | |
|---|---|---|---|---|
| 3,915,438 A | | 10/1975 | Neiley, Jr. et al. | |
| 4,062,472 A | * | 12/1977 | Taube | 222/1 |
| 4,073,664 A | | 2/1978 | Zwirlein | |
| 4,347,004 A | * | 8/1982 | Platts | 366/137 |
| 4,358,026 A | * | 11/1982 | Makinen | 222/1 |
| 4,486,102 A | | 12/1984 | Thiele et al. | |
| 4,544,277 A | | 10/1985 | Schnellmann | |
| 4,546,922 A | | 10/1985 | Thometz | |
| 4,637,527 A | | 1/1987 | Arrigoni | |
| 4,705,461 A | * | 11/1987 | Clements | 417/387 |
| 4,792,092 A | * | 12/1988 | Elberson et al. | 239/305 |
| 4,948,042 A | | 8/1990 | Tench et al. | |
| 5,288,525 A | * | 2/1994 | Diana | 239/305 |
| 5,482,745 A | * | 1/1996 | Cuellar et al. | 427/421 |
| 5,758,571 A | * | 6/1998 | Kateman et al. | 99/455 |
| 5,816,700 A | * | 10/1998 | Stark, Sr. et al. | 366/147 |

FOREIGN PATENT DOCUMENTS

| | | |
|---|---|---|
| EP | 0 201 683 | 11/1986 |
| EP | 0 277 365 | 8/1988 |
| EP | 0 715 883 | 6/1996 |

OTHER PUBLICATIONS

International Search Report for PCT/EP98/07091, filed Jun. 11, 1998 Date of mailing of search report: Apr. 14, 1999.

* cited by examiner

*Primary Examiner*—Kevin Shaver
*Assistant Examiner*—Davis Hwu
(74) *Attorney, Agent, or Firm*—Flynn, Thiel, Boutell & Tanis, P.C.

(57) ABSTRACT

A dispensing machine for the metered delivery of fluid products, especially painting products. The dispensing machine includes a dispensing head with a nozzle, and the ends of a plurality of delivery ducts communicate with the dispensing head in order to feed a plurality of fluid products thereinto. A mixing device, in particular a rotating turbine, is mounted between the ends of the delivery ducts and the dispensing nozzle to continuously mix the fluid products coming from the different delivery ducts and simultaneously entering the dispensing head.

14 Claims, 5 Drawing Sheets

DISPENSING MACHINE FOR THE METERED DELIVERY AND CONTINUOUS HOMOGENIZATION OF FINISHED PAINT PRODUCTS

TECHNICAL FIELD

The present invention relates to a dispensing machine for the metered delivery of fluid products, especially fluid ingredients that make up finished products such as varnishes, paints, inks, enamels, textile dyes and similar products.

BACKGROUND ART

In order to obtain the finished products given above as examples, it is known to add one or more colorant fluid products to a base fluid, such as white or transparent, in predetermined proportions according to specific formulas. Known machines used in the above industry deliver known amounts of colorants into cans, containers, tins or bins of a predetermined capacity, into which the base fluid products have previously been placed. These known machines must ensure high precision in determining the amount of colorant product to dispense, since even slight differences in the relative proportions among the various colorant products or between these and the base fluid product may lead to finished products having a color that does not match the desired result. At any rate, after delivery by traditional dispensing machines, the distribution of colorant products in the mass of base fluid product is not homogeneous, and it is therefore necessary to shake the can more or less vigorously.

This necessary shaking phase is obviously a burden on the production process for finished products using the so-called tinting systems as it leads to additional manual labor—often difficult due to the size and weight of the cans—or the use of specialized mixing machines, thereby increasing system costs. In any case, however, mixing also considerably increases the production time of finished products.

Thus, at the state of the art today, the homogenization stage is on the bottleneck in terms of the productivity of a rapid dispensing machine, and in any case limits the use of tinting systems to products with good fluidity, and does not allow the use of highly viscous products of those containing large amounts of solid or plastic particles.

SUMMARY OF THE INVENTION

The purpose of the present invention is to resolve the above difficulties, in particular to provide a dispensing machine of the type indicated in the preamble of the present description that allows metered delivery and continuous homogenization of finished painting products. The primary object of the invention is to obtain a finished, colored painting product at the machine outlet that does not require any further blending.

Another purpose of the present invention is to eliminate the mixing machines traditionally combined with dispensing machines to increase the productivity of a tinting system.

A further purpose of the invention is to integrate and automate the various production phases of finished paint products, expanding the range of component products that may be used in a tinting system.

A further purpose of the invention is to integrate and automate the various production phases of finished paint products, expanding the range of component products that may be used in a tinting system.

In order to achieve the above objects, the invention regards a dispensing machine of the type indicate in the preamble to this description, with the features set forth in the attached claims.

BRIEF DESCRIPTION OF THE DRAWINGS

Additional features and advantages shall become apparent from the following description of one preferred embodiment, with reference to the enclosed figures, provided solely as non-limiting examples, wherein.

DETAILED DESCRIPTION

Figure 1:
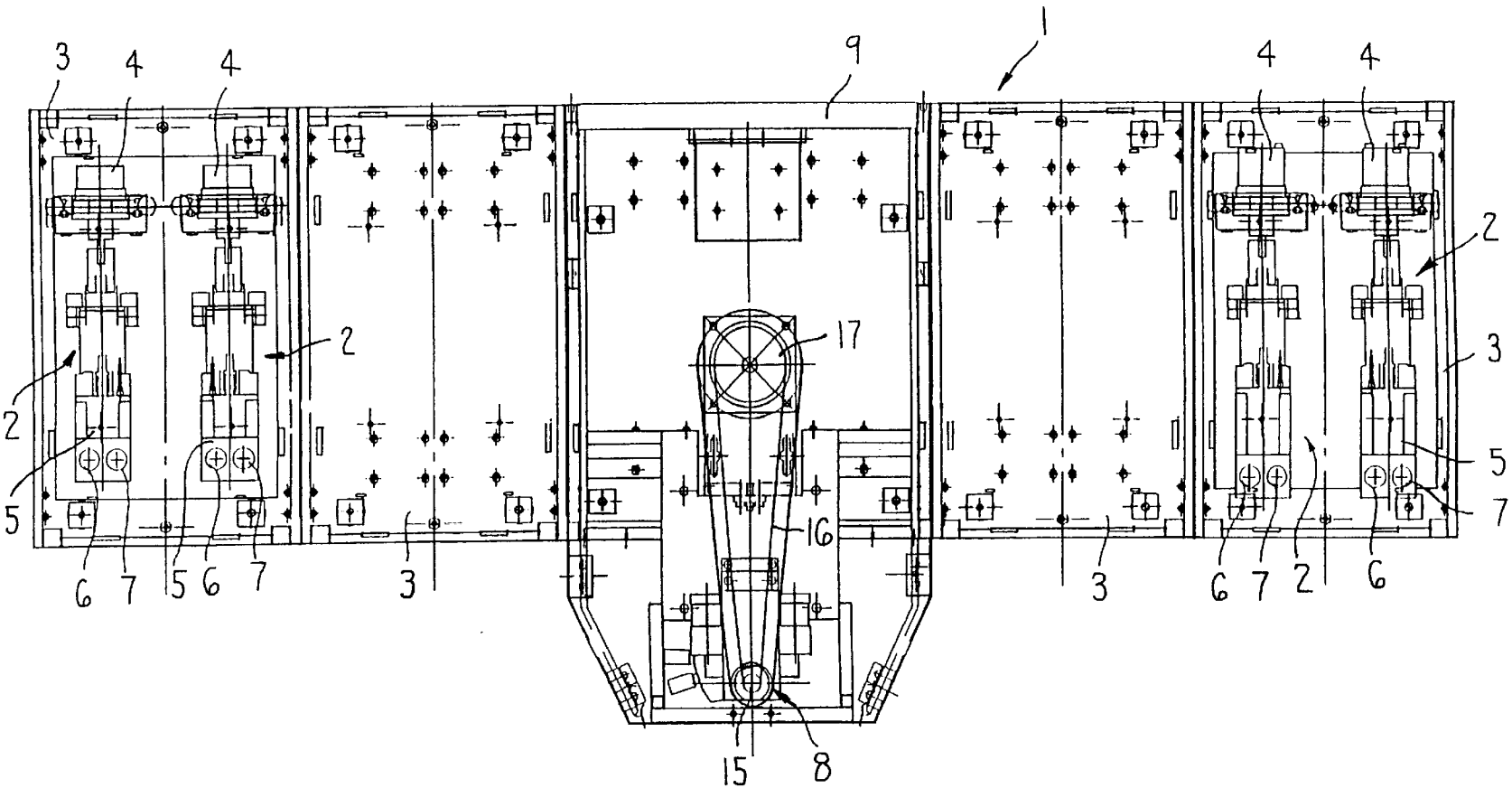
FIG. 1 is a schematic plan view of a dispensing machine built according to the invention, from which the upper covering panels have been removed for clarity.

With reference now to the figures, reference number 1 indicates generally a dispensing machine comprising multiple motor pump units 2, preferably housed in modular frames 3, to allow the machine to be easily expanded according to the number and variety of component products to be dispensed. Each motor pump unit includes a motor 4, preferably but not limitatively a brushless electric motor, whose operation is controlled independently from that of the motors of the other motor pump units by means of a control circuit of known type, preferably interfaced with a computer. In particular, the control circuits regulate the rotation speed of the motors 4, each of which is connected to the shaft of a corresponding positive-displacement pump 5 provided with inlet openings 6 and outlet openings 7. The inlet openings 6 are connected to reservoirs (not shown in the figure) of component products-bases, colorants, various types of additives, etc. The outlet openings are instead connected to distribution lines 10 (the path of which is shown by the dashed line in FIGS. 2 and 3), with the interposition of three-way, two-position recirculation valves 11*a,* 11*b,* from which the recirculation lines also branch out to return the component products to their respective reservoirs. The distribution lines 10 are conveyed to a dispensing unit 8, located in the upper portion of a central dispensing module 9, which also preferably contains the control electronics of the motor pump units 2 and the recirculation valves 11*a,* 11*b* associated with each reservoirs, as well as the computer.

Figure 2:
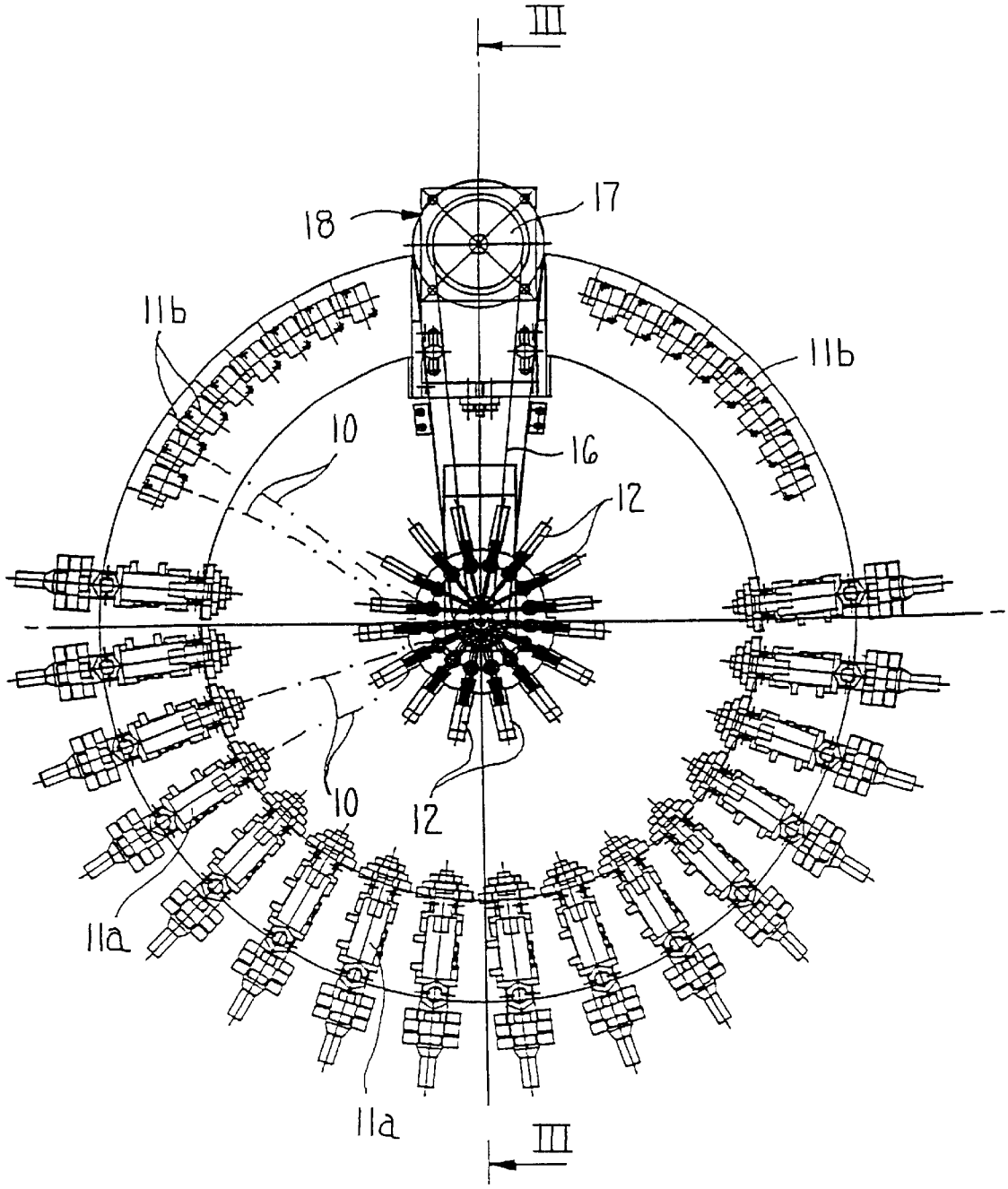
FIG. 2 is a plan view of the dispensing unit of the machine in FIG. 1.
Figure 3:
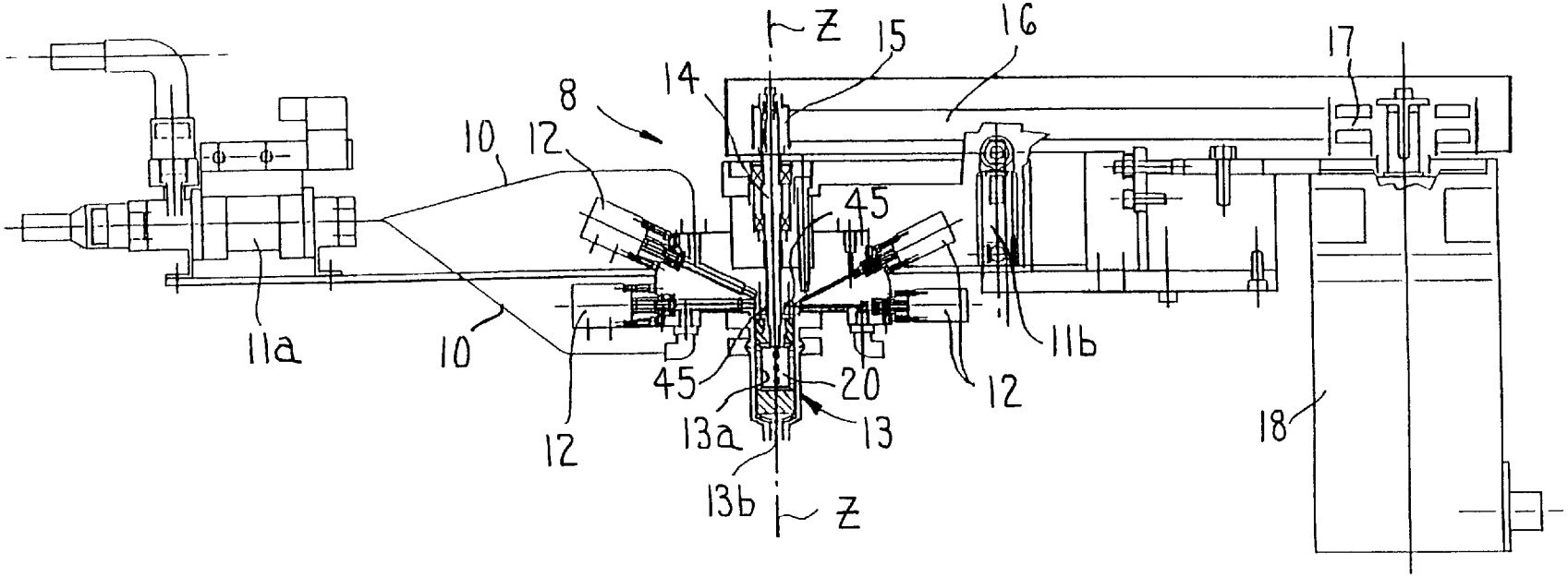
FIG. 3 is a longitudinal cross-section of the dispensing unit according to line III—III in FIG. 2.

As can be seen more clearly in FIGS. 2 and 3, the ends of the distribution lines 10 are closed by valve devices 12, preferably pin valves, which may open selectively to connect the distribution lines 10 to an axial bore 13*a* of a dispensing head 13, which opens to the outside through a dispensing nozzle 13*b*. A mixing device, for example a turbine 20, rotating around a substantially vertical axis Z—Z, is mounted inside the dispensing head 13. In particular, although not limitatively, the turbine 20 is attached to one end of a rotating shaft 14, a wheel or pulley 15 being keyed to the other end thereof which extends above the dispensing unit 8. The pulley 15 is connected to a pulley or drive wheel 17, attached to the shaft of a mixing motor 18, by means of a belt or chain 16. It is obviously possible to adopt different but functionally similar construction systems to transmit motion from the motor 18 to the mixing device 20, such as for example a gear transmission, a universal joint, or other functionally similar system.

FIGS. 2 and 3 show a sample configuration of the dispensing unit 8 of a dispensing machine adapted to dispense up to sixteen different bases and sixteen different colorants. The three-way valves 11*a,* which provide selective dispensing of bases or their recirculation to the corresponding reservoirs, are arranged in a semicircle around the dispensing head 13.

The three-way valves 11*b,* smaller because they are used to selectively dispense colorants, are arranged in arcs on both sides of the motor 18. The pin valves 12, one for each three-way valve 11*a,* 11*b,* are arranged in a circle around the dispensing head 13. To keep the system compact, in the configuration shown the pin valves 12 are stacked vertically in pairs, as can be clearly seen in FIGS. 3 and 5.

Figure 4:
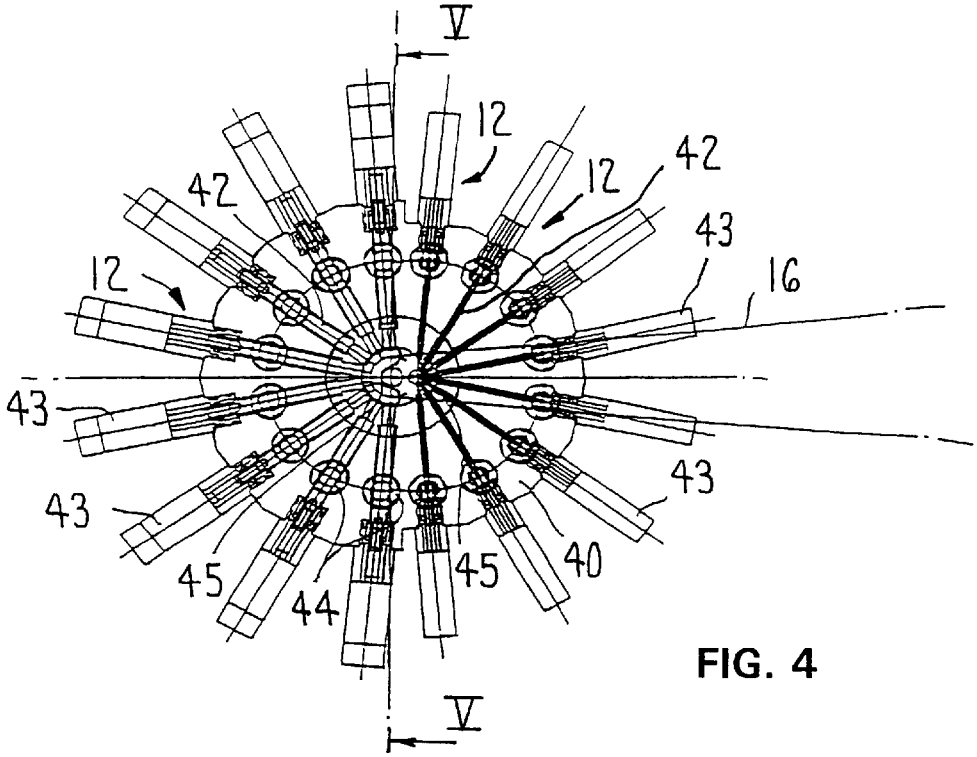
FIG. 4 is an enlarged plan view of the dispensing head in FIG. 2.
Figure 5:
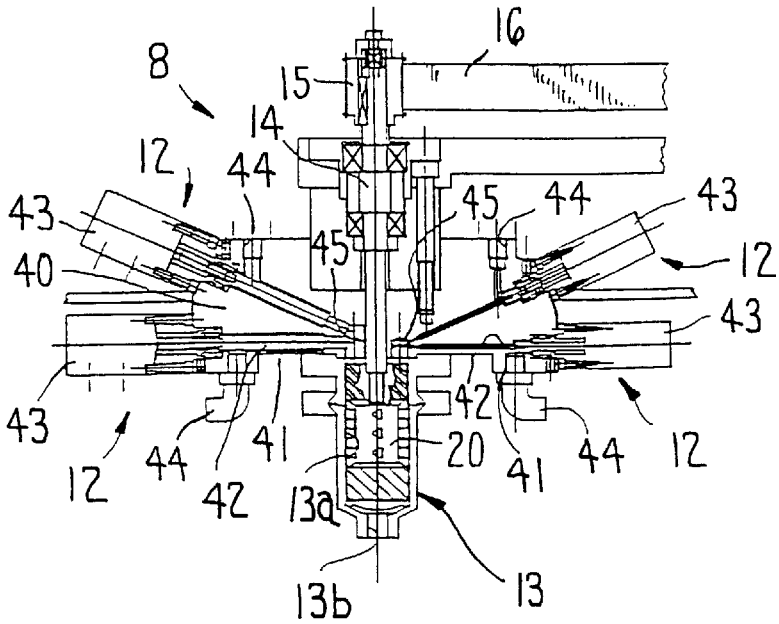
FIG. 5 is a longitudinal cross-section of the dispensing head according to line V—V in FIG. 4.

As can be more clearly seen in FIGS. 4 and 5, the pin valves 12 are mounted on a ring support 40, wherein radial ducts 41 are provided in which the pins 42 of the valves 12 can move axially, selectively controlled by actuators 43. Each radial duct 42 communicates with a corresponding inlet opening 44, to which a corresponding line 10 is connected as it arrives from the three-way valves 11*a,* 11*b.* The radial ducts 41 open into one or more shared chambers 45 which, in turn, communicates with the axial bore 13*a* of the dispensing head 13, upstream from the turbine 20.

Figure 6:
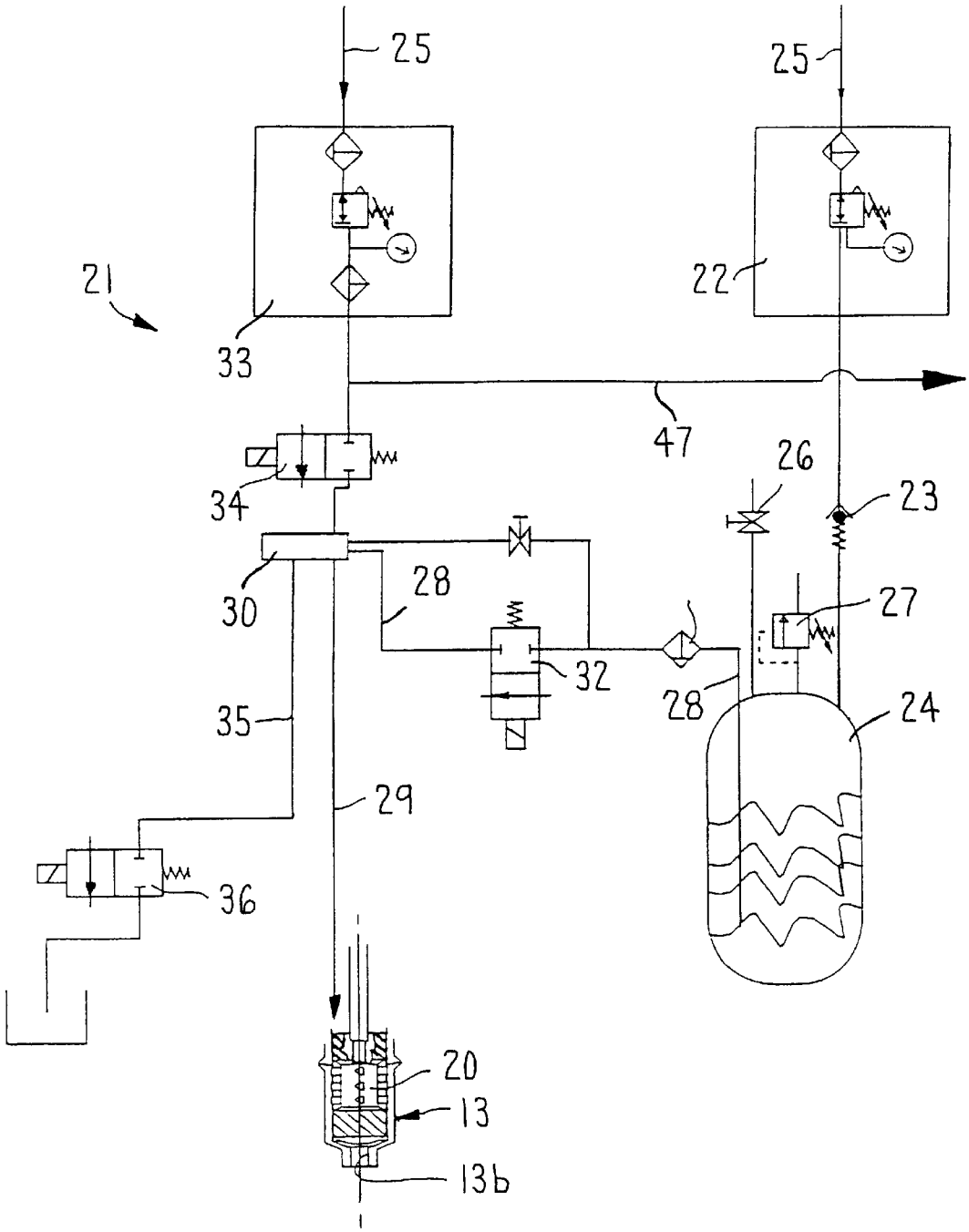
FIG. 6 is a diagram of the washing system of the dispensing head in FIGS. 4 and 5.

Between dispensing a finished product having a certain formula and the next product, having a different formula, it is necessary to clean the shared nozzle 13 and the turbine 20. To this end, the machine 1 comprises a washing unit 21 illustrated schematically in FIG. 6.

The washing unit 21 comprises a pressure regulator 22, through which compressed air from a pneumatic infeed circuit 25 is delivered. The compressed air is sent through a non-return valve 23 to a tank 24 containing a solvent suited to the type of colorant products and bases used. The solvent is added to the tank 24 through a cap 26, after deactivating or closing the pneumatic infeed circuit 25. A safety valve 27 ensures that the pressure in the tank does not exceed a desired preset level. An outlet duct 28 connects the tank 24 to a manifold 30, from which in turn leads a washing duct 29 that opens into the dispensing head 13, upstream from the turbine 20. Along the outlet duct 28 there are interposed a filter 31 and a solvent washing solenoid valve 32 that selectively enables entry of the solvent into the dispensing nozzle 13.

The compressed air coming from the pneumatic infeed circuit 25 is also used to feed the solenoid valves 11*a,* 11*b* through the ducts 47, after passing through a second pressure regulator 33. The air outlet duct from the second regulator 33 also communicates with the manifold 30, with the interposition of an air washing solenoid valve 34. A discharge duct 35 is also connected to the manifold 30, and is selectively closed by a discharge solenoid valve 36.

During operation of the dispensing machine 1, a predetermined formula defining the proportions of components products to make up a certain finished product is, for example, selected or entered by the user via the computer. A consent command enables transmission of data from the computer to the control systems of the motor pump units 2, which regulate the speed of the motors 4 and thus the flow rate of the pumps 5. Until the speed and throughput of all of the pumps 5 involved in the formula has stabilized, the solenoid valves 11*a,* 11*b* are kept in the recirculation position. When a steady condition is reached, the recirculation valves 11*a,* 11*b* and the pin valves 12 for the products required by the formula, generally comprising a base and one or more colorants, are opened simultaneously to convey said ingredients to the dispensing unit 8. The component products enter the chambers 45, then move into the dispensing head 13 in predetermined proportions in terms of amount per unit of time. The products are then immediately blended by the mixing turbine 20 powered by the motor 18, which may be run at constant or variable speed depending on the component products, so as to provide the turbine 20 with a preferably high speed, sufficient to blend the component products perfectly. Thus the finished product arrives at the outlet of the dispensing nozzle 13*b,* and only needs to be packaged in the desired containers.

The automatic washing unit 21 of the dispensing head 13 is activated upon a command sent by the computer at each formula change. The washing cycle takes place with the solenoid valves 11*a,* 11*b* in recirculation position, with all pin valves 12 closed, with the discharge solenoid valve 36 and air washing solenoid valve 34 closed, and with the turbine 20 activated. The solvent washing solenoid valve 32 opens to allow solvent to enter the dispensing head 13, upstream from the turbine 20. The solvent delivery phase lasts long enough to allow complete and thorough washing of the chambers 45, the dispensing head 13 and the mixing turbine 20. When this phase is complete by closing the solvent washing solenoid valve 32, a new phase begins in which air enters thanks to the opening of the air washing solenoid valve 34. This phase removes any residual solvent remaining inside the dispensing head 13 and in contact with the turbine 20. The washing cycle is completed by switching the air solenoid valve 34 to the closed position and by opening the discharge solenoid valve 36. This discharge valve 36 is also kept open while fluid products are dispensed, to avoid surge pressures in the dispensing nozzle. To better understand the operating principle of the dispensing machine described above in one particular embodiment, a specific example of dispensing with details regarding machine parts, which must not be construed as restrictive in any way, is hereinbelow described.

EXAMPLE 1

Pumps 5 have been selected having different specifications for dispensing bases and colorants.

For colorants, the pumps have a flow rate of 3 ml of product per revolution, and can achieve a maximum rotation speed of 150 rpm. For the bases, the pumps have a flow rate of 25 ml per revolution, and a maximum speed of 150 rpm.

Let us assume we wish to produce a finished paint product having a simple formula, in which a base B is diluted by 1% of its volume with a colorant C. The finished product, having a known specific weight, should have a total weight corresponding to a volume of 1010 CC.

To produce the desired amount of product in the shortest possible time, the base pump B is set up to rotate at its maximum speed of 150 rpm, corresponding to a flow rate of 62.5 ml/s of base product. The time needed to dose 1000 cc of base product is therefore 16 seconds. The central computer thus calculates the flow rate of colorant C needed to dispense 10 cc in 16 seconds, so that the proportion between the base and colorant entering the dispensing nozzle is constant over time. Given the displacement of the colorant pump, the computer system calculates that the corresponding motor must run at a speed of 12.5 rpm. This information is sent to the control system of the motor 4, which brings the circulation flow in the recirculation circuit to the required cycle speed.

The two products involved in the formula, base B and colorant C, are thus sent to the dispensing head 13 and mixing device 20 at the above rates.

Within 16 seconds, the dispensing nozzle 13*b* releases the required amount of finished product, already dosed and blended.

The machine according to this invention may be built with fluid product reservoirs mounted directly on the machine, or located in adjacent modules, or may have only the central structure 9 containing the distribution unit and a set of inlet openings to which one may connect fluid feed lines from external or remote reservoirs via generally know means, such as through a screw coupling or quick fitting.

Naturally, the principle of the invention remaining the same, the embodiments and development details may vary widely from those described and illustrated without exceeding the extent of the present invention.

What is claimed is:

1. Dispensing machine for the metered delivery of fluid products, especially painting products, comprising a dispensing head with a dispensing nozzle, a plurality of delivery ducts having ends which communicate with the dispensing head to feed fluid products thereinto, mixing means disposed between the ends of the delivery ducts and the dispensing nozzle to continuously mix the fluid products coming from different delivery ducts and simultaneously entering the dispensing head, wherein the mixing means includes a rotating turbine, the delivery ducts being radial ducts the ends of which communicate with one or more shared chambers placed upstream from the mixing means in relation to the dispensing nozzle.

2. Dispensing machine according to claim 1, further including a plurality of reservoirs for the fluid products to be dispensed, pumping means being interposed on the ducts to transfer the fluid products from the reservoirs to the dispensing head.

3. Dispensing machine according to claim 2, wherein the pumping means are adjustable to transfer different fluid products at different flow rates.

4. Dispensing machine according to claim 1, further including a plurality of reservoirs for dispensing the fluid products and interception means interposed on the ducts to selectively interrupt the transfer of fluid products from the reservoirs to the dispensing head.

5. Dispensing machine according to claim 4, wherein the interception means include openable and closable valves disposed at the ends of the ducts which when open communicate with the dispensing head.

6. Dispensing machine according to claim 4, wherein the interception means include three-way valves from which recirculation ducts branch off to selectively transfer the fluid products either to the dispensing head or to the reservoirs.

7. Dispensing machine according to claim 5 wherein an even number of the valves are arranged circularly and are stacked vertically in pairs around the dispensing head.

8. Dispensing machine according to claim 1, further including a washing unit having a solvent tank to which a first solvent washing duct is connected, a second air washing duct connected to a source of compressed air, the first and second washing ducts communicating with the dispensing head with the interposition of respective interception means which are selectively activable to open or close the communication between the washing ducts and the dispensing head.

9. A machine for dispensing a fluid product such as paint, said machine comprising:

a dispensing head defining a nozzle therein through which the fluid product is discharged;

a plurality of fluid delivery ducts for feeding fluid products into said dispensing head from a plurality of fluid reservoirs; and a mixing arrangement including a bladed turbine disposed within said dispensing head, said turbine defining a rotational axis about which said turbine rotates to mix fluid products simultaneously entering said dispensing head from the respective fluid delivery ducts, wherein terminal ends of said fluid delivery ducts communicate with a shared chamber which is coaxially oriented with said turbine axis and located on an upstream side of said turbine, said nozzle being coaxially oriented with said turbine axis on a downstream side of said turbine.

10. The device of claim 9 wherein said dispensing head defines a bore in which said turbine is disposed, and said mixing arrangement includes a rotating shaft disposed within said bore to which said turbine is connected for rotation therewith.

11. The device of claim 10 wherein said chamber is defined around said shaft.

12. The device of claim 10 wherein said dispensing head and said shaft are vertically oriented, a lower end of said shaft being connected to said turbine and an upper end of said shaft being operatively connected to a motor for driving said shaft.

13. The device of claim 9 further including a first plurality of valves each of which is provided at said terminal end of a said fluid delivery duct to control flow of fluid into said shared chamber, and a second plurality of valves each of which communicates with a said fluid delivery duct upstream of the respective first valve to selectively allow flow of the respective fluid product to said dispensing head through said fluid delivery duct or to the respective reservoir through a recirculation duct.

14. The device of claim 13 wherein said first plurality of valves are pin valves which are mounted in a generally circular arrangement on a ring-shaped support wherein pairs of said pin valves are mounted in a vertically stacked manner on said support, and said second plurality of valves are three-way, two position valves which are arranged in a generally circular arrangement in surrounding relation with said pin valve.

* * * * *